US007306401B1

(12) United States Patent
Linkogle

(10) Patent No.: US 7,306,401 B1
(45) Date of Patent: Dec. 11, 2007

(54) APPARATUS FOR CONVEYING FLUIDS

(75) Inventor: Les L. Linkogle, Temecula, CA (US)

(73) Assignee: Silent, LLC, Lake Elsinore, CA (US)

( * ) Notice: Subject to any disclaimer, the term of this patent is extended or adjusted under 35 U.S.C. 154(b) by 113 days.

(21) Appl. No.: 11/352,130

(22) Filed: Feb. 11, 2006

(51) Int. Cl.
*E02B 5/02* (2006.01)

(52) U.S. Cl. ..... 405/118; 405/121

(58) Field of Classification Search ..... 405/118–121, 405/270, 268
See application file for complete search history.

(56) References Cited

U.S. PATENT DOCUMENTS 1,031,407 A * 7/1912 Williams ..... 405/121
3,156,099 A * 11/1964 Dailey ..... 405/121
3,854,292 A * 12/1974 Nienstadt ..... 405/270
3,872,676 A 3/1975 Nagao
4,299,171 A * 11/1981 Larson ..... 104/70
4,345,853 A 8/1982 Fisher
4,693,633 A 9/1987 Giordano
5,066,165 A * 11/1991 Wofford et al. ..... 405/119
5,340,234 A 8/1994 Rossi
5,735,638 A 4/1998 Beamer
5,803,662 A 9/1998 Gunter
6,202,358 B1 3/2001 Janesky
6,227,763 B1 * 5/2001 Kuhns ..... 405/38
6,273,640 B1 * 8/2001 Suazo ..... 405/121
6,692,186 B1 2/2004 Suazo
6,722,818 B1 * 4/2004 Suazo et al. ..... 405/121
6,805,517 B2 10/2004 Chapek
7,156,580 B2 * 1/2007 Suazo et al. ..... 405/118

* cited by examiner

*Primary Examiner*—Frederick L. Lagman
(74) *Attorney, Agent, or Firm*—Dennis W. Beech

(57) ABSTRACT

The present invention may be assembled for use in conveying fluids flowing on terrain. A conduit may have two elongated side walls and a bottom connector formed in an approximate V cross section shape. The two elongated side walls may have an upper flange with an edge element that may have an expanded diameter relative to the upper flange thickness. A side panel may have a length that is approximately the same as the two elongated side walls. The side panel may have a groove in each longitudinal edge for attachment to the edge element. The side panel may be attached to a terrain ground structure.

23 Claims, 3 Drawing Sheets

APPARATUS FOR CONVEYING FLUIDS

BACKGROUND OF THE INVENTION

This invention relates to apparatus for conveying fluids flowing on a terrain. The new apparatus may have a generally V shape conduit with rotatably positional side panels that may be used to attach the conduit to a structure or the terrain. There may be support elements to support the conduit and other elements elevated above the terrain surface.

Known drainage channels generally may be constructed of concrete. Other constructs of fluid flow control channels may include plastic, metal, tile or other rigid structures. These drainage channel apparatus and methods may be designed for lining in an existing drainage structure or for simply burying in the terrain or ground. A corrugated wall structure may be used in a water transport apparatus to allow for several features, one of which may be to have a flexible channel. These systems may not have a simple, positional terrain anchor element or a device to support channel elements above the ground.

These and other features, aspects and advantages of the present invention will become better understood with reference to the following drawings, description and claims.

SUMMARY OF THE INVENTION

The present invention is directed to apparatus for conveying fluids flowing on terrain. A conduit may have two elongated side walls and a bottom connector formed in an approximate V cross section shape. The two elongated side walls may have an upper flange with an edge element that may have an expanded diameter relative to the upper flange thickness. A side panel may have a length that is approximately the same as the two elongated side walls. The side panel may have a groove in each longitudinal edge for attachment to the edge element. The side panel may be attached to a terrain ground structure.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
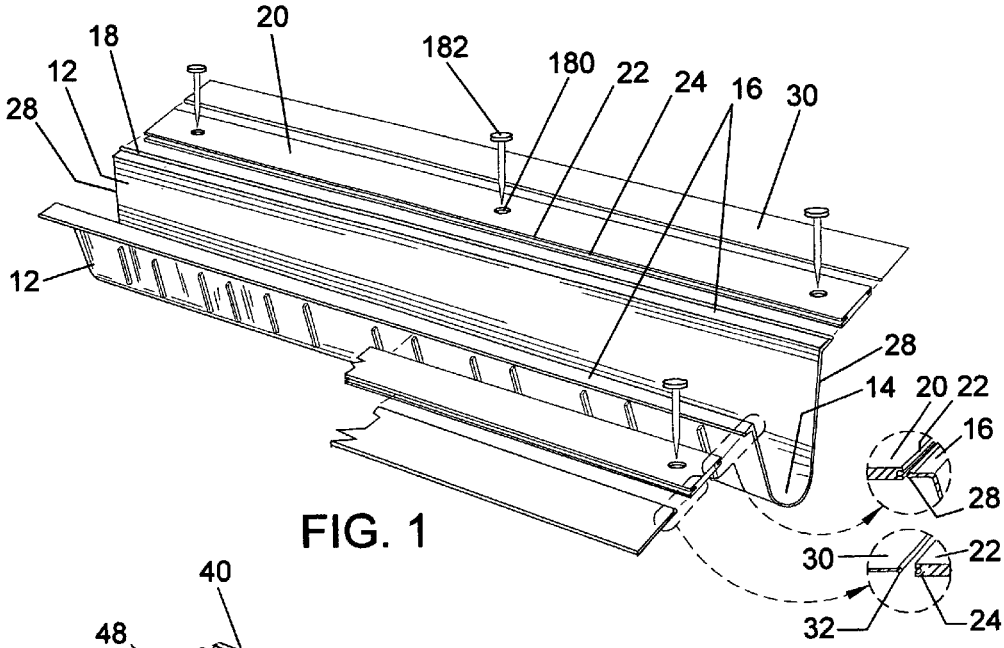
FIG. 1 illustrates a perspective view of a conduit according to an embodiment of the invention.

Referring to FIG. 1, a drainage system for conveying fluids flowing on terrain may have a conduit 10 that may have two elongated side walls 12 and a bottom connector 14 to form a conduit in an approximate V cross sectional shape with an open top. The elongated side walls 12 may have an upper flange 16 with an edge element 18 that may have a larger or expanded diameter relative to the thickness of the upper flange 16. The edge element 18 may have a generally circular, hexagonal or other suitable cross section shape.

A side panel 20 may have a length approximately equal to the length of the elongated side walls 12. The side panel 20 may have a groove 24 in one or both longitudinal edges 22. The groove 24 may be sized for a frictional fit on the edge element 18 and also to allow for some rotational movement about the edge element 18. The side panel 20 may have anchor apertures 180 for insertion of spikes 182 to attach the side panel 20 to a terrain ground structure.

A flexible panel 30 may have an expanded edge portion 32 for frictional engagement with the groove 24 for further extension of a support structure adjacent the conduit 10. The flexible panel 30 may allow pushing therethrough of a spike 182.

Figure 2:
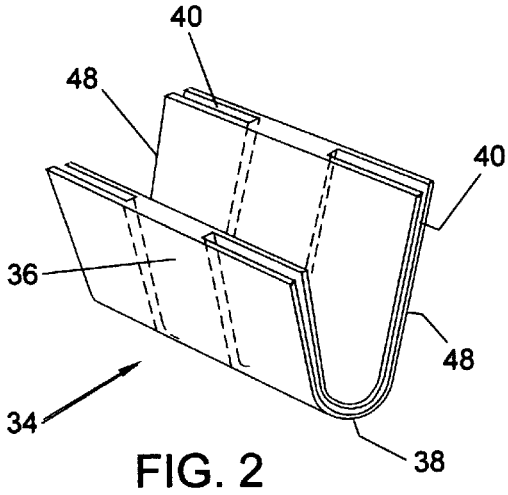
FIG. 2 illustrates a perspective view of a coupling element according to an embodiment of the invention.
Figure 3:
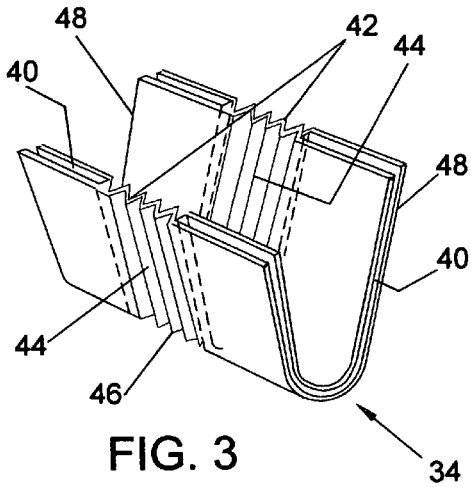
FIG. 3 illustrates a perspective view of a coupling element according to an embodiment of the invention.

Referring to FIGS. 1 through 3, a coupling element 34 may have two coupling side walls 36 joined by a coupling bottom element 38 and may be formed in an approximate V cross sectional shape compatible with the conduit 10. There may be a slot 40 formed in each end 48 of the coupling element 34 and the slot 40 may be sized for receipt of an end portion 28 of a conduit 10. The coupling element 34 may have a flexible portion 42 for limited lateral or vertical motion of one end 48 relative to the other end 48. The flexible portion 42 may be an accordion structure formed in a coupling side wall portion 44 and a coupling bottom portion 46.

Figure 4:
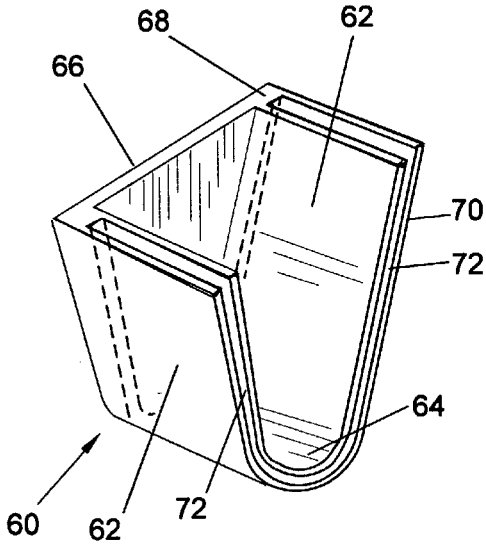
FIG. 4 illustrates a perspective view of an end cap element according to an embodiment of the invention.

Referring to FIGS. 1 and 4, an end cap element 60 may have two cap side walls 62 and a cap bottom element 64 that may be formed in an approximate V cross section shape compatible with conduit 10. There may be an end wall 66 of generally triangular shape attached at a first cap end 68. A second cap end 70 may have a slot 72 sized for receipt of an end portion 28 of a conduit 10.

Figure 5:
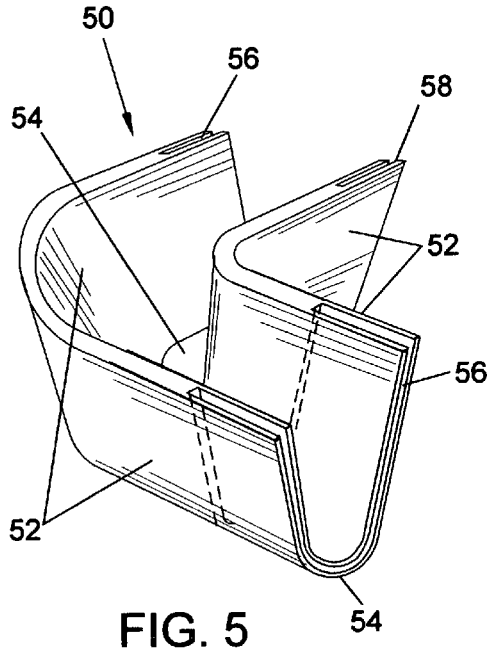
FIG. 5 illustrates a perspective view of an angular coupling element according to an embodiment of the invention.

Referring to FIGS. 1 and 5, an angular coupling element 50 may have two side walls 52 and an angular bottom element 54 formed in an approximate V cross section shape compatible with conduit 10 and curved in a longitudinal axis. A slot 56 may be formed in each end 58 sized for receipt of an end portion 28 of a conduit 10. The angular coupling element 50 may be curved at a 90 degree angle or other desired angular orientation.

Figure 6:
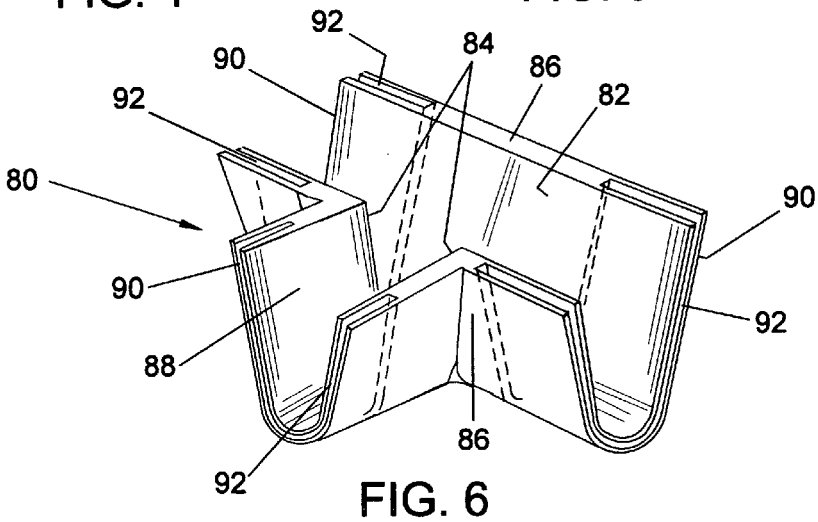
FIG. 6 illustrates a perspective view of a T element according to an embodiment of the invention.

Referring to FIGS. 1 and 6, a T element 80 may have a first conduit 82 with an opening 84 therein in one wall 86. A second conduit 88 may be attached at the opening 84 and extend approximately orthogonal from the first conduit 82. The ends 90 of the T element 80 may have a slot 92 sized for receipt of an end portion of a conduit 10.

Figure 7:
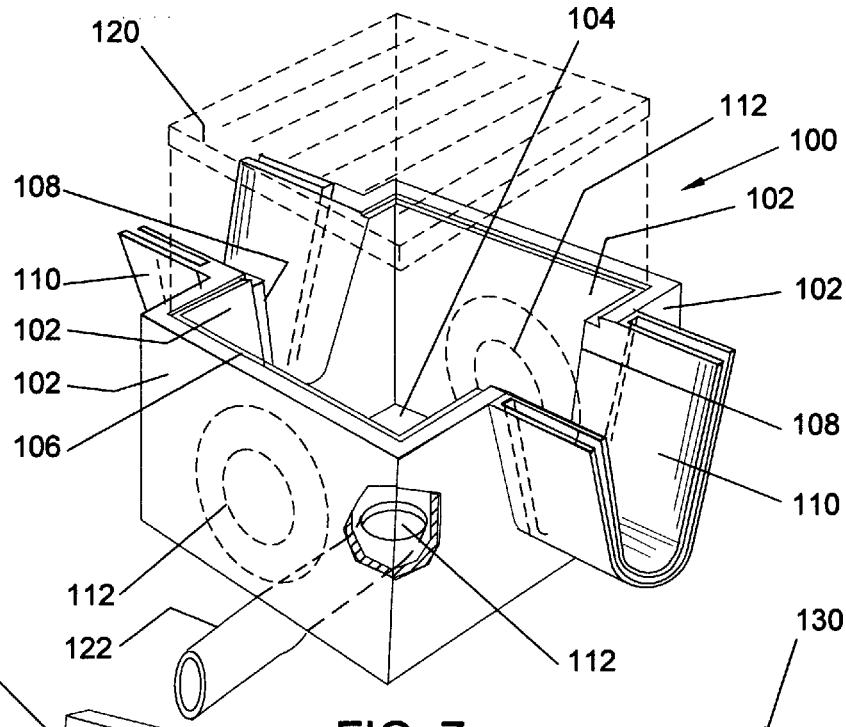
FIG. 7 illustrates a perspective view of a catch basin according to an embodiment of the invention.

Referring to FIGS. 1 and 7, a catch basin 100 may have side walls 102, a bottom wall 104 and an open top 106. One or more of the side walls 102 may have an opening 108 that may have a basin coupling element 110 attached that may extend approximately orthogonally from the side wall 102. The bottom wall 104 may have an outlet port 112 and a side wall 102 may also have an outlet port 112. A drain pipe 122 may be attached to an outlet 112. The catch basin 100 may be generally rectangular or have other shapes, such as, cylindrical, oval or other container forms. There may be a grate 120 disposable in the open top 106.

Figure 8:
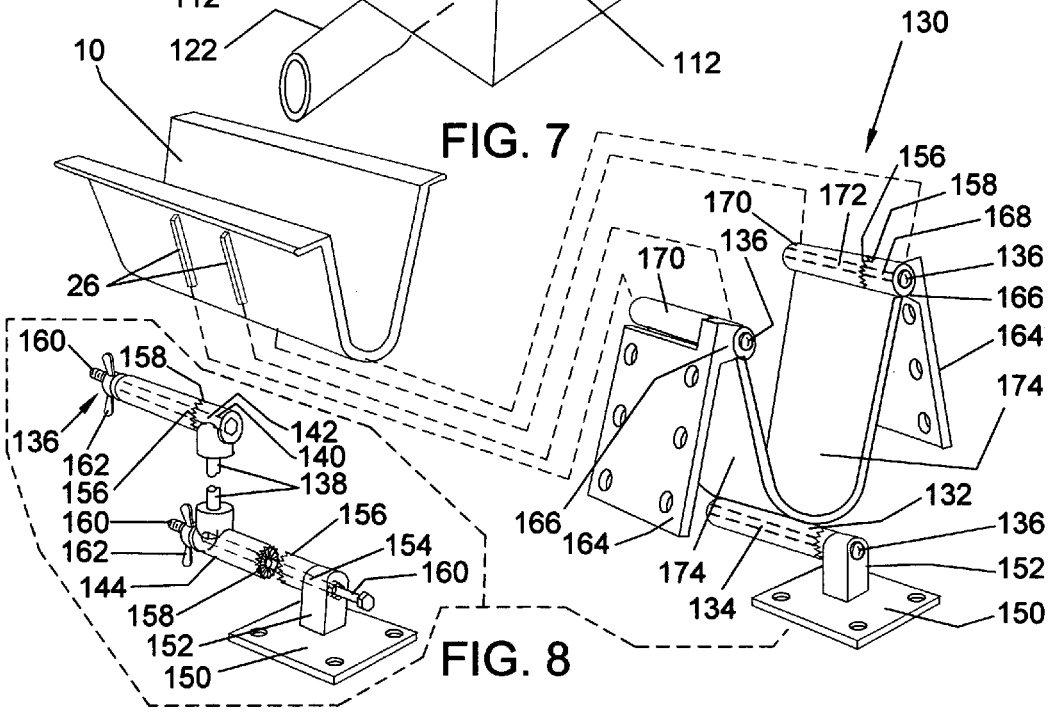
FIG. 8 illustrates a perspective view of a support element according to an embodiment of the invention.

Referring to FIGS. 1 and 8, a support element 130 may have an approximately V cross section shape for receipt of a conduit 10. The conduit 10 may have ribs 26 laterally formed in the external surface. The ribs 26 may be spaced apart for a frictional fit contact against a side element 174 of the support element 130 when a conduit 10 is place in a support element 130. A bottom portion 132 may have a bore 134 for receipt of a fastener 136 that may be for example a bolt 160 that may be theadably engagable with a wing nut 162. An extension pole 138 may have an upper connector 140 having an aperture 142 for inserting the fastener 136 and a lower connector 144 having a second aperture 146 for receipt of a second fastener 148. A base element 150 may have a pedestal 152 with a base aperture 154 for insertion of the second fastener 148 to attach the two elements together. The base element 150 may be attachable to a terrain ground structure.

The bottom portion 132 and the upper connector 140 may have mating toothed surfaces 156, 158 to retain the element in a fixed position once the bolt 160 and wing nut 162 have been tightened. There may also be toothed surfaces 156, 158 on lower connector 144 and the pedestal 152 to retain these elements in a fixed position.

The side element 174 may have an upper edge 170 that may have a bore 172 for inserting a fastener 136 for attachment of an attachment plate 164. The attachment plate 164 may have an attachment flange 166 with an attachment aperture 168 for inserting the fastener 136 therethrough. The attachment plate 164 may be rotated to a desired position for attachment to a structure or a ground terrain structure.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus for conveying fluids flowing on terrain comprising;

a conduit having two elongated side walls and a bottom connecting element formed in an approximate V cross section shape;

said two elongated side walls having an upper flange with an edge element having an expanded diameter cross section relative to the thickness of said flange;

a side panel having a length of said two elongated side walls and having in a longitudinal edge a groove sized for attachment to said edge element; and said side panel attachable to a terrain ground structure.

2. The apparatus as in claim 1 wherein a flexible panel is attached to a second longitudinal edge opposite said edge element.

3. The apparatus as in claim 1 wherein:

a coupling element having two coupling side walls and a coupling bottom element formed in an approximate V cross section shape; and said coupling element having at each end a slot therein sized for receipt of an end portion of said conduit.

4. The apparatus as in claim 3 wherein said coupling element having a flexible portion formed in said coupling side walls and said coupling bottom element.

5. The apparatus as in claim 4 wherein said flexible portion is a wall portion and a bottom portion having an accordion form.

6. The apparatus as in claim 1 wherein:

an end cap element having two cap side walls and a cap bottom element formed in an approximate V cross section shape;

an end wall of generally triangular shape attached at a first cap end; and at a second cap end having a slot therein sized for receipt of an end portion of said conduit.

7. The apparatus as in claim 1 wherein:

an angular coupling element having two side walls and an angular bottom element formed in a curved longitudinal axis; and said angular coupling element having at each end a slot therein sized for receipt of an end portion of said conduit.

8. The apparatus as in claim 1 wherein:

a T element having a first conduit with an opening therein in one wall;

a second conduit attached at said opening and extending approximately orthogonally from said first conduit; and each end of said T element having a slot therein sized for receipt of an end portion of said conduit.

9. The apparatus as in claim 1 wherein:

a catch basin having a side wall, a bottom wall and an open top;

said side wall having an opening therein;

a basin coupling element attached at said opening and extending approximately orthogonally from said side wall; and said bottom wall having an outlet port therein.

10. The apparatus as in claim 9 wherein said side wall having a second outlet port therein.

11. The apparatus as in claim 10 wherein said side wall having a second opening therein opposite said opening; and a second basin coupling element attached at said second opening and extending approximately orthogonally from said side wall.

12. The apparatus as in claim 9 wherein said catch basin is a rectangular structure having four side walls.

13. The apparatus as in claim 9 wherein a grate disposed on said open top.

14. The apparatus as in claim 9 wherein a drain pipe is attached to said outlet port.

15. The apparatus as in claim 1 wherein said elongated side walls having a plurality of lateral external ribs.

16. The apparatus as in claim 1 wherein:

a support element having an approximate V cross section shape for disposing said conduit therein;

a bottom portion having a bore for receipt of a fastener;

an extension pole having an upper connector having an aperture for inserting said fastener therethrough and a lower connector having a second aperture for receipt of a second fastener;

a base element having a pedestal having a base aperture for inserting said second fastener therethrough and said base element attachable to said terrain ground structure.

17. The apparatus as in claim 16 wherein said bottom portion adjacent said bore having a toothed surface and said upper connector adjacent said aperture having second toothed surface disposed to mate with said toothed surface.

18. The apparatus as in claim 16 wherein said pedestal adjacent said base aperture having a toothed surface and said lower connector adjacent said second aperture having a second toothed surface disposed to mate with said toothed surface.

19. The apparatus as in claim 16 wherein said fastener and said second fastener are a bolt and a wing nut.

20. The apparatus as in claim 16 wherein:

a side element of said support element having in an upper edge a bore for inserting a fastener therethrough; and an attachment plate having an attachment flange having an attachment aperture for receipt of said fastener.

21. The apparatus as in claim 20 wherein said upper edge adjacent said bore having a toothed surface and said attachment flange adjacent said attachment aperture having a second toothed surface disposed to mate with said toothed surface.

22. The apparatus as in claim 20 wherein said attachment plate having an anchor aperture for inserting a spike therethrough.

23. The apparatus as in claim 15 wherein said lateral external ribs are spaced apart for a frictional contact against a side element of a support element when said channel is disposed in said support element.

* * * * *